US008990986B2

(12) United States Patent
Sanders et al.

(10) Patent No.: US 8,990,986 B2
(45) Date of Patent: Mar. 31, 2015

(54) BABY CHANGING PAD WITH POCKET FOR WIPES

(71) Applicants: Natalie C. Sanders, Salinas, CA (US); Glen Sanders, Salinas, CA (US)

(72) Inventors: Natalie C. Sanders, Salinas, CA (US); Glen Sanders, Salinas, CA (US)

( * ) Notice: Subject to any disclaimer, the term of this patent is extended or adjusted under 35 U.S.C. 154(b) by 6 days.

(21) Appl. No.: 13/948,900

(22) Filed: Jul. 23, 2013

(65) Prior Publication Data

US 2013/0312197 A1 Nov. 28, 2013

Related U.S. Application Data

(63) Continuation-in-part of application No. 12/835,566, filed on Jul. 13, 2010, now abandoned.

(51) Int. Cl.

| | |
|---|---|
| ***A47G 9/06*** | (2006.01) |
| ***A47D 5/00*** | (2006.01) |
| ***A47G 9/10*** | (2006.01) |
| ***A45C 9/00*** | (2006.01) |
| *A45C 11/26* | (2006.01) |

(52) U.S. Cl.

CPC *A47D 5/00* (2013.01); *A47D 5/006* (2013.01); *A47G 9/1045* (2013.01); *A45C 9/00* (2013.01); *A45C 11/26* (2013.01)

USPC ..... 5/655

(58) Field of Classification Search

CPC ..... A47D 5/006

USPC ..... 5/417, 419, 420, 485, 655, 640, 645, 5/636, 639

See application file for complete search history.

(56) References Cited

U.S. PATENT DOCUMENTS

| | | | | |
|---|---|---|---|---|
| 6,176,356 | B1 * | 1/2001 | Powley | 190/1 |
| 7,467,433 | B2 * | 12/2008 | Wong | 5/655 |
| 7,752,692 | B1 * | 7/2010 | Sanders et al. | 5/655 |
| 8,002,115 | B2 * | 8/2011 | Rappaport et al. | 206/581 |
| 2005/0278855 | A1 * | 12/2005 | Welch | 5/655 |
| 2008/0229506 | A1 | 9/2008 | Saman | |
| 2009/0178204 | A1 * | 7/2009 | Sager | 5/655 |

OTHER PUBLICATIONS

Printout: Response to Final Office Action, dated Jul. 23, 2013, of U.S. Appl. No. 12/835,566, filed Jul. 13, 2010 (now abandoned in favor of CIP U.S. Appl. No. 13/948,900) for applicant Natalie C. Sanders, entitled Baby Changing Pad with Integral Baby Wipes, 4 pages.

* cited by examiner

*Primary Examiner* — Michael Trettel
(74) *Attorney, Agent, or Firm* — Thomas Schneck

(57) ABSTRACT

A baby changing pad having an internal water-resistant pocket for storing wipes includes a sealable end opening to the internal pocket for ingress of wipes and a top opening through the pad to the pocket through which wipes are dispensed.

15 Claims, 9 Drawing Sheets

BABY CHANGING PAD WITH POCKET FOR WIPES

CROSS-REFERENCE TO RELATED APPLICATION

This is a continuation-in-part application which claims priority from application Ser. No. 12/835,566 filed Jul. 13, 2010 which is a continuation-in-part application of application Ser. No. 12/460,992 filed Jul. 28, 2009, now U.S. Pat. No. 7,752,692 which are hereby incorporated by reference.

TECHNICAL FIELD

The field of the present invention relates generally to equipment for baby care and, more specifically, to a changing pad or surface with a storage volume for wipes.

BACKGROUND

Venturing out of the home with a baby can be a daunting challenge for a parent. Babies have many needs and require constant care. A large number of products are available on the open market for baby care. Selecting just which products to bring along, and figuring out how to transport them without misplacing any can be overwhelming. Frequent returns to an automobile packed with baby care items are a normal occurrence for any parent attempting to run errands with a baby. Struggling with bulky or overflowing bags of baby care items can make even a small trip out to a restaurant loom large with logistics, rendering it an infrequent event, to the detriment of parental bliss.

An object of the invention is to combine diverse baby care equipment into a single article.

SUMMARY

The above object has been met with a baby changing pad, or baby tending surface or support, with opposite ends, with one end having an internal waterproof pocket for free wipes that are dispensed or accessed through a top opening in the pad. The internal waterproof pocket has a sealable end opening for ingress of free baby wipes. The opening is sealed with a fastener. In one example, the fastener provides an airtight seal to the internal pocket. Fasteners that may be used include ZIPLOC bag type fasteners, plastic zippers, slider zippers or other fastening means. Baby wipes are defined to include commercial pre-moistened fiber tissues or dry toiletry paper, such as facial tissue, bathroom tissue, and paper towels. The pad may have a plurality of parallel, joined folding sections or may be flat. It may include external pockets for storing baby items such as diapers.

A pillow-forming section may optionally be at an opposing second end of the pad. The pillow-forming section can act as part of the pad.

A pocket forming fabric piece is optionally attached to the pillow-forming section of the flexible pad so as to form a pocket, making the pillow-forming section openable. The pillow-forming section may be the only visible section when the remaining sections of the pad are folded into the pocket.

A first surface of the pad may be liquid resistant, such as soft vinyl, plastic or canvas. An opposing second surface of the pad may be made of a first woven fabric. The pocket fabric piece is a portion of the pocket. The pocket fabric piece may be made of a second fabric, or the first fabric. The pocket fabric piece forms a portion of the outside of the pillow. A portion of the second surface of the pad may form a portion of the outside of the pillow.

At least a center region of a folding pad section is stitched to enclose padding material. The padding may thin where the folding sections join. At least one folding section may have a resilient material between the first surface of the pad and the second surface of the pad. At least one folding section may have a foam sheet between a first and second surface of the pad. The first and second surfaces of the pad may be attached between the folding sections, near the fold lines. Stitching may be between the folding sections. Stitching may be through the first and second surfaces of the pad. Stitching may define the fold lines. Stitching may at least partially secure a foam sheet that forms padding.

The pad may be notched at the edges where the folding sections join. The notches ease folding at the fold lines and contribute to a more rounded pillow.

The baby wipe storage volume, in the stowage section of the pad, may be sealable as with a hinged or screwed on lid. The storage volume may be configured to removably contain baby wipes with a container that snaps onto the lid, or alternatively, has a container lip that allows insertion of the container through the pad surface into the storage volume. Alternatively, the changing pad may have a side or bottom port where the container may be inserted. However, wipes are dispensed through an opening in the pad surface. There may be a second openable storage volume in the stowage section. The second storage volume may be securable, as with a fastener or lockable lid.

The second storage volume may be configured to removably contain a diaper, a baby garment, a nursing cover, or debris.

The pillow may have a handle or a shoulder strap. The shoulder strap may be adjustable.

DETAILED DESCRIPTION

Figure 1:
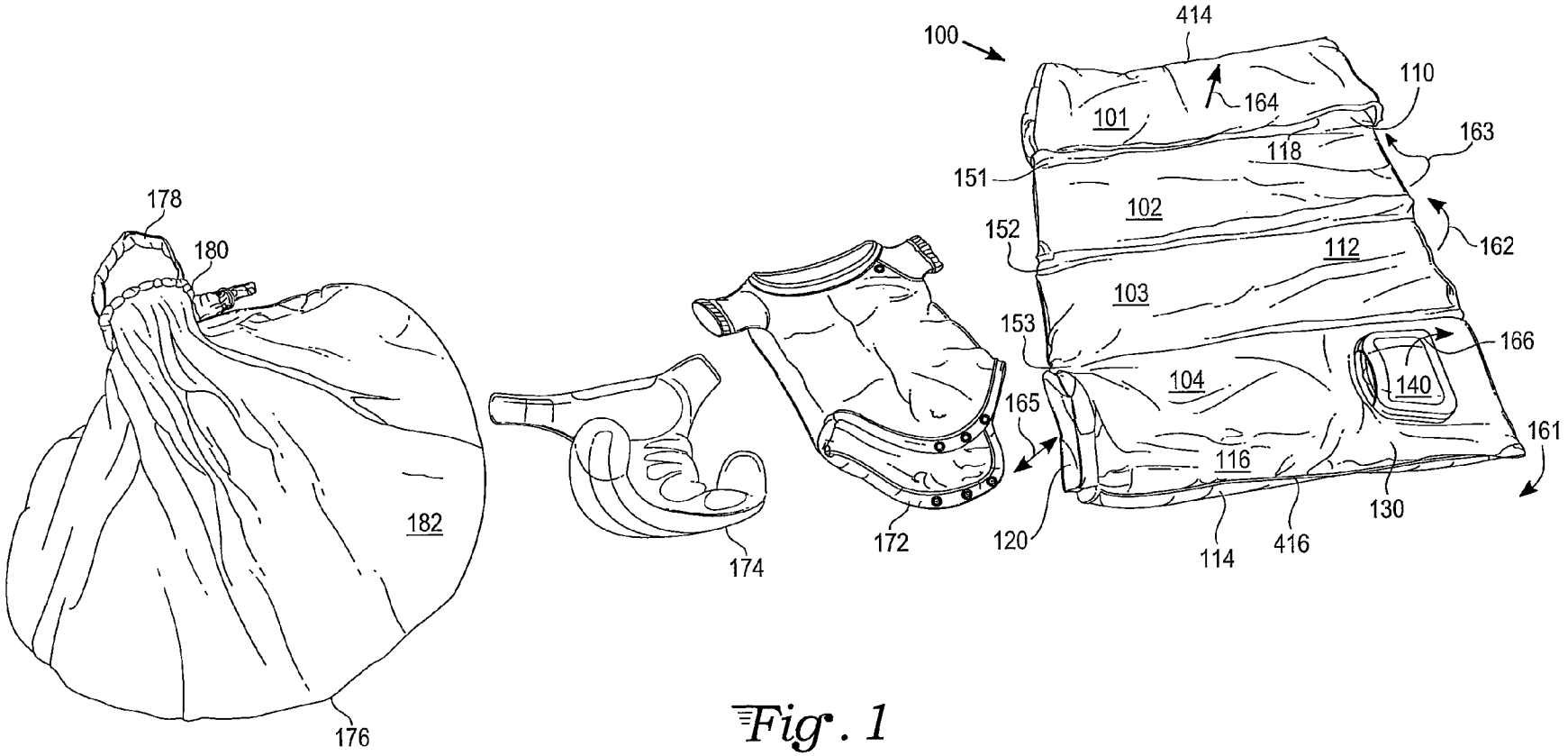
FIG. 1 shows an exploded view of an embodiment of a baby changing apparatus in accordance with the invention.

With reference to FIG. 1, a preferred baby changing apparatus in a pillow 100 includes a select few baby care items carried in a specialized, convertible container. The specialized, convertible container is itself useful, as it is a pillow suitable for resting a baby or parent's head. While this embodiment is preferred, other embodiments can have a flat baby changing surface.

The pillow 100 is formed in a pocket 110 that contains a folded baby changing pad 112 operating as the filler of the pillow. A first storage volume 130 of the pad and a second storage volume 120 may hold various contents. A baby garment 172, a diaper 174 and a nursing cover 176 may be placed in the second storage volume 120. An essential element is a baby tending surface with opposed ends.

A nursing mother may place the strap 178 of the nursing cover 176 over her head and around the back of her neck. The curved apron 182 of the nursing cover 176 may be discreetly arranged by the mother as she breast-feeds her baby.

Boning 180, hemmed in or otherwise attached along the neckline of the nursing cover and forming a half circle below the mother's chin, may be discreetly lifted by the mother so that she may check on her infant. The boning 180 may be a flexible or elastic shape retaining material, which gives the mother better control over the lifting of the nursing cover when peeking. A rounded shape of the apron 182 of the nursing cover 176 provides fabric to the right and left sides of the mother, so she can tuck or move the fabric around for privacy.

Figure 2:
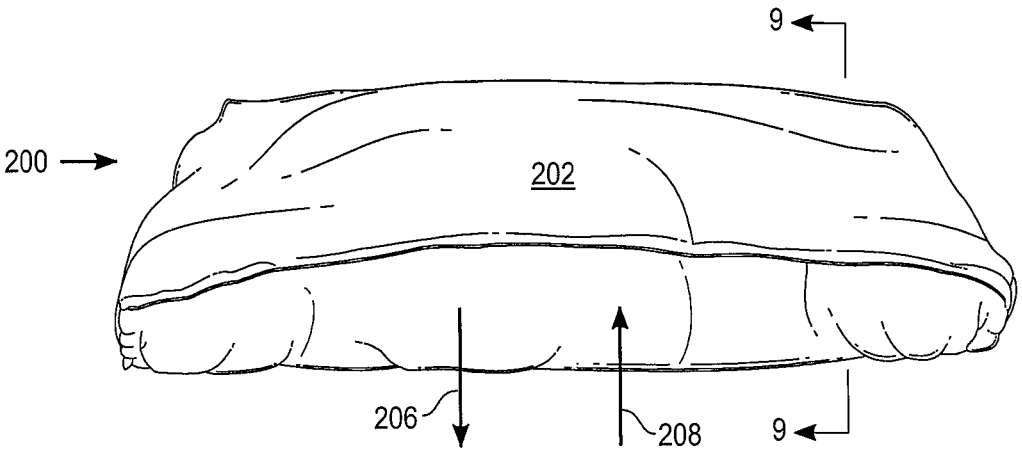
FIG. 2 shows a plan view of the pillow of FIG. 1, as formed by folding.

In FIG. 2 the baby changing apparatus is converted to a pillow 200 formed by folded, tucked pad sections. Folded sections of the pad may be pulled out of a pocket in the pillow 200. The folded sections of the pad are pulled in a pillow unfolding direction 206 when unfolding the pillow 200 to form the pad. A pocket fabric piece 202, attached to the body of the pillow, is a portion of the receiving pocket.

Figure 9:
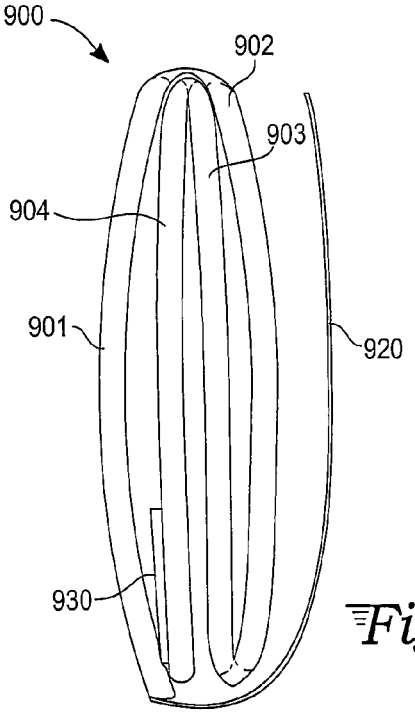
FIG. 9 is a cross-section view of the pillow of FIG. 2, showing the sections of the pad as folded and tucked with the folding sequence of FIGS. 6-8.

When forming the pillow 200, the pad sections are folded and inserted or tucked into the pocket in a pillow forming direction 208. A cross-section view of the pillow 200, revealing the folded sections, is shown in FIG. 9 and will be discussed in greater detail along with a folding sequence.

Figure 3:
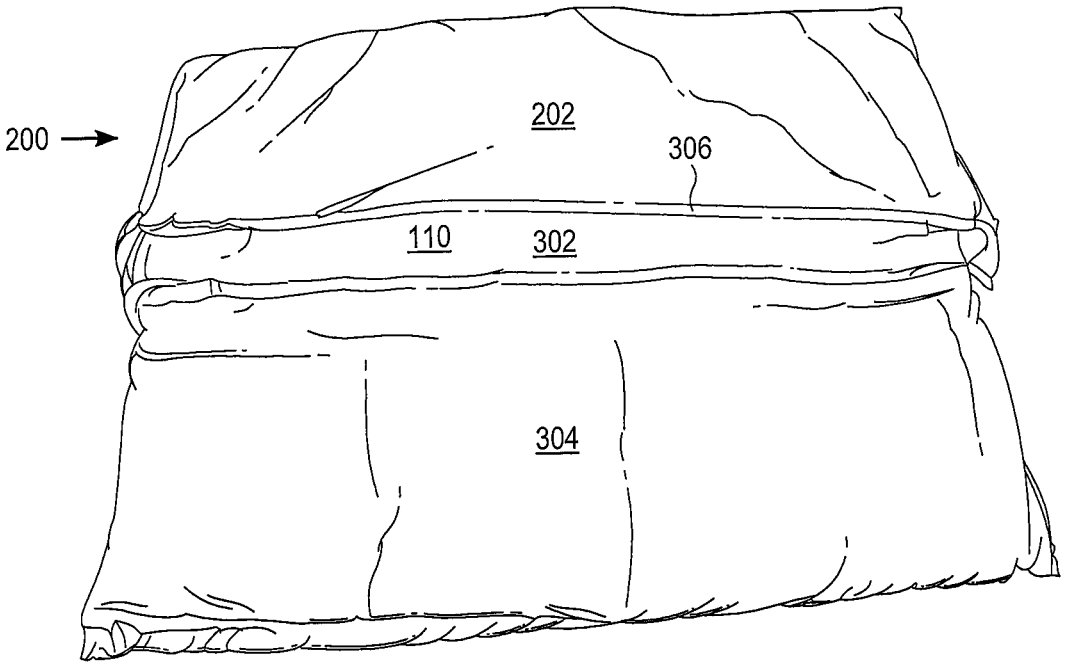
FIG. 3 depicts the pillow of FIG. 2 showing folding pad sections pulled from the pocket of the pillow-forming section, ready to continue unfolding to form the pad.

In FIG. 3 folded sections 304 are pulled from the pocket 110. The pocket piece 202 may be made of fabric or an elastic material or may be fabric with an elastic band 306. Expandability of the elastic material or band may allow for ease of tucking the folded sections 304 into the pocket 110, or flexibility in the total volume of items stowed in a storage volume. Expandability of the elastic material or band may further allow for ease of pulling the pocket piece 202 around the folded sections 304.

In FIG. 3, the folding pad sections 304 are partially deployed from the pillow 200, and are ready to continue unfolding to form the pad 112. The sections 304 are also depicted folded and ready to tuck into the pocket 110, to form the pillow 200.

Figure 4:
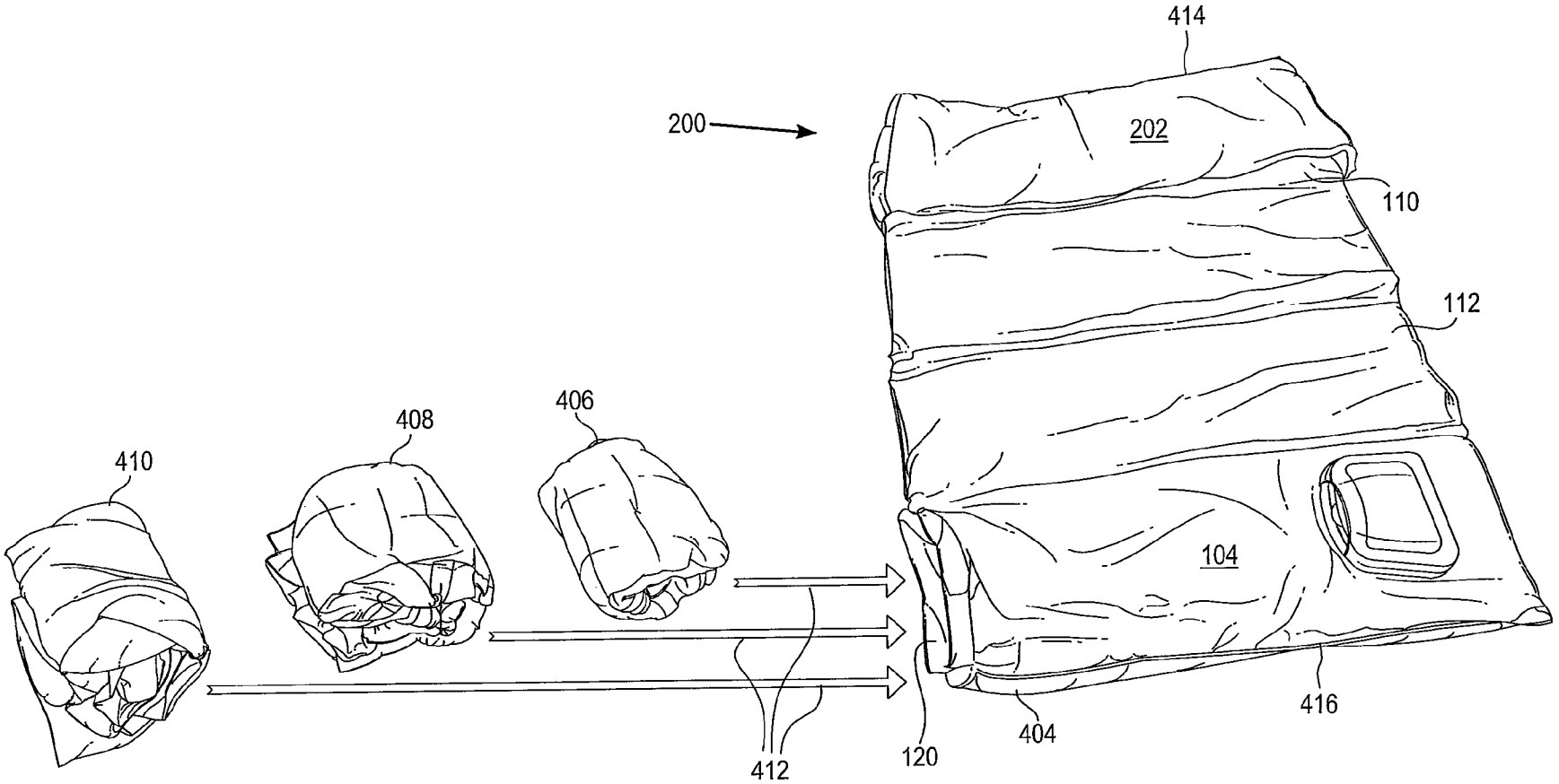
FIG. 4 shows a plan view of the apparatus of FIG. 3, as unfolded from the formed pillow, showing the pad with three baby care items rolled and ready to stow in a storage volume in the stowage section.

In FIG. 4 the pad 112 is seen to be unfolded from the formed pillow 200. The pocket 110 and pocket piece 202 are visible at a first end 414 of the pad 112. The pocket opens towards an opposed second end 416 of the pad 112. Three baby care items 406, 408 and 410 are shown rolled and ready to stow, as pointed to by arrows 412, in a second storage volume 120 in the stowage section 104 of the pad 112.

Returning to FIG. 1, various characteristics and operating actions of an embodiment of a baby changing apparatus in a pillow 100 are shown. A pocket 110 in a pillow-forming section 101 may be opened in a pocket opening direction 164. The pillow-forming section 101 is at the first end 414 of the pad 112 and is openable towards the opposing second end 416 of the pad 112.

Folding sections 101, 102, 103, and 104 are joined and fold at fold lines 151, 152 and 153, which can be stitched regions that divide the folding sections. The folding sections are rectangular and parallel to each other. The pillow-forming section 101 is one of the folding sections. The baby wipe stowage section 104 is a further one of the folding sections. Although the baby wipe stowage section 104 may be at the second end 416 of the pad 112, the baby wipe stowage section 104 may also be located closer to the pillow-forming section 101.

In the baby wipe stowage section 104, a first storage volume 130 holds a container of baby wipes, which are often available premoistened. In order to retain the moisture, a sealable lid 140 such as a hinged lid, screwed on lid or hatch is preferred as part of the pad surface. The lid 140 may be openable in a lid opening direction 166. Opening the lid 140 allows the baby wipes to be dispensed, withdrawn or removed. The first storage volume 130 and the lid 140 may be an integral part of the stowage section 104 and allow baby wipes to be inserted and removed from the first storage volume 130, which may be moisture resistant. The first storage volume 130 may hold a removable container of baby wipes that joins with the lid 140. Such a removable container may hold baby wipes and be replaceable. A lid is not essential for the changing pad in the situation where a container of baby wipes has its own lid. In this case, the container would have a lip that seats on a rim in the changing pad surface. The rim and the lip have the same shape as that the lip fits onto and over the rim.

In the baby wipe stowage section 104, a second storage volume 120 may be openable and securable. The second storage volume 120 may be a type of storage pocket, for example, and be openable, in a second storage volume opening direction 165, near a side edge of the pad 112. A fastener such as hook and loop strips, a zipper, snap buttons, a clamp, a lockable lid and or a fold over fabric may serve to secure the second storage volume 120 and any contents thereof.

Except for disposable types, most baby changing pads are cleanable and reusable. In order to achieve this goal, a first surface 116 of the pad 112 in an embodiment may be liquid resistant. Soft vinyl, plastic, canvas or other flexible material may be used. The pad is usually placed with the liquid resistant first surface 116 facing up, and the baby is changed upon this surface.

An opposing second surface 114 of the pad 112, which usually faces downward during baby changing, may be made of a fabric. A portion of the first surface 116, at the pillow-forming section 101, forms a pocket backing 118. The pocket piece 202 is attached to the pillow-forming section 101, so that the pocket piece 202 and the pocket backing 118 form the pocket 110. The pocket piece 202 and a portion of the second surface 114 of the pad 112, at the pillow-forming or first end 414 of the pad 112, form part of the outside of the pillow 200. The pocket piece 202 may also be made of a fabric, which may be the same type of fabric as, or similar to, or different from the fabric of the second surface 114 of the pad 112. Since a portion of the second surface 114 of the pad 112 and the pocket piece 202 are on the outside of the pillow 200, the fabric or fabrics may be chosen for a comfortable feel and a pleasant appearance of the pillow 200, and may be matched or contrasted in color and pattern. The pad 112 may be used as a sleeping mat for the baby, by placing the pad with the second surface 114 facing upward.

For the comfort of the baby, the pad 112 may be at least partially padded. One or more of the folding sections may be padded in at least a center region. In an embodiment, the pillow-forming section 101 and middle sections 102 and 103 are padded, and the stowage section makes use of the softness of the contents for padding or goes without padding if empty. In an embodiment, foam sheets, cut to size, are used for padding. A washable foam may be used for padding. Batting may be used for padding. Another resilient material may be used for padding.

While a non-folding surface may be used, a portable folding changing pad is illustrated. For ease of folding, the pad 112 may thin where the folding sections join, at the fold lines 151, 152, and 153. To achieve this thinning, the first 116 and second 114 surfaces of the pad 112 may be attached to each other at or near the fold lines, between the folding sections. In an embodiment, stitching between the folding sections defines the fold lines 151, 152, and 153. The stitching goes through the first 116 and second 114 surfaces of the pad. Foam sheets in sections 101, 102, and 103 are secured by the stitching along the fold lines 151, 152, and 153 and by stitching attaching the first surface 116 to the second surface 114 around the edges of the pad 112. Other means of thinning, attaching or securing the surfaces or defining the fold lines may be employed. Other means of securing a foam sheet, a resilient material or padding may be employed.

Figure 5:
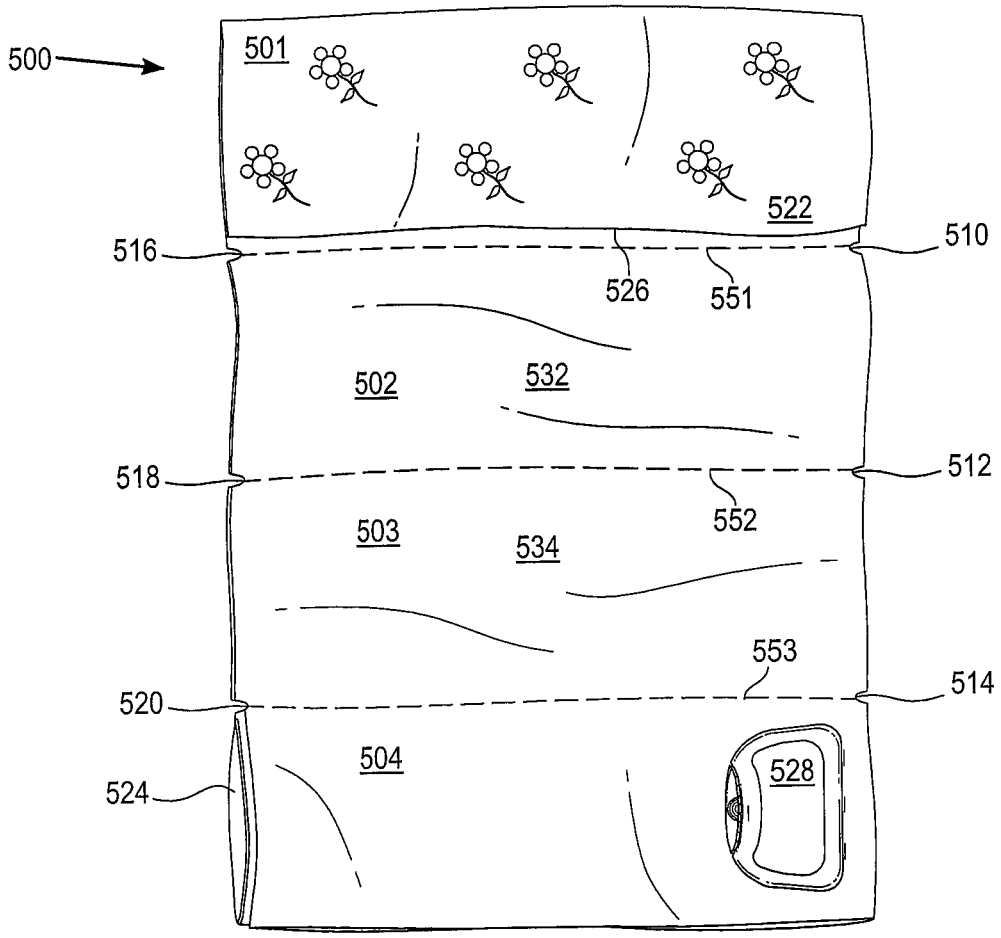
FIG. 5 shows an alternate embodiment of a baby changing pad.

FIG. 5 shows a further embodiment of a baby changing apparatus in a pillow 500. Folding sections 501, 502, 503, and 504 are joined and fold at fold lines 551, 552 and 553. Notches 510, 512, 514, 516, 518, and 520 along opposing edges of the pad 532, at the fold lines 551, 552, and 553 where the folding sections 501, 502, 503, and 504 join, make folding the pad 532 easier. The notches, which may be V-shaped cuts in an edge, further contribute to a rounding of the pillow. A first storage volume in the stowage section 504 has a replaceable wipe container with a snapping lid 528. A second storage volume 524 is in the stowage section 504. Pocket piece 522 forms a portion of the pocket 526. Pocket piece 522 is a fabric that is folded over a vinyl side 534 of the pad 532 and used to tuck the sections 502, 503, and 504 in.

Figure 6:
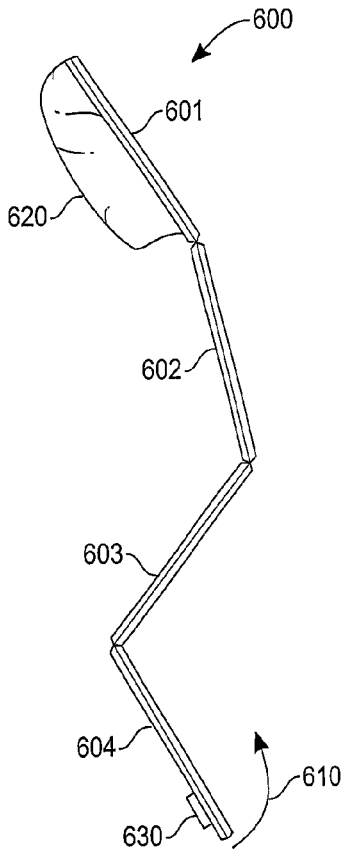
FIG. 6 is a profile view of an embodiment of a baby changing apparatus in a pillow, indicating fold directions for the pad at the start of a folding sequence.

FIG. 6 is a profile view of an embodiment 600. Fold directions for the pad, at the start of a folding sequence, are indicated. Three of the sections start out as an alternating or zigzag fold. Directions are herein given with regard to a pad with the pocket piece 620 and the lid 630 facing upwards. Stowage section 604, shown with a lid 630, is folded downward or under a second middle section 603, in a downward or under direction 610.

Figure 7:
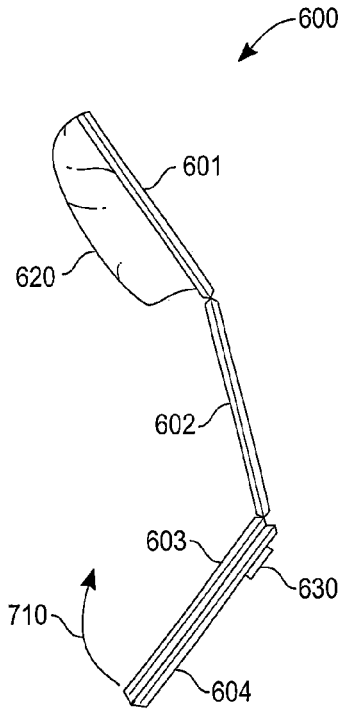
FIG. 7 is a profile view of the embodiment of FIG. 6, continuing the folding sequence.

FIG. 7 continues the folding sequence. Stowage section 604 and second middle section 603 are folded upward or on top of first middle section 602, in an upward or on top direction 710. Alternatively, an accordion fold pattern may be used.

Figure 8:
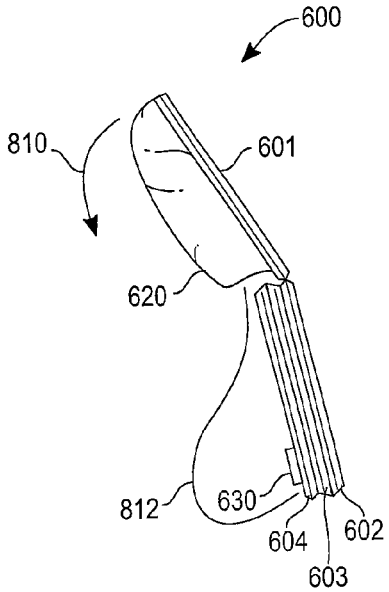
FIG. 8 is a profile view of the embodiment of FIG. 6, finishing the folding sequence. Folded sections are shown ready to be tucked into the pocket to form the pillow.

FIG. 8 finishes the folding sequence. FIG. 8 shows an embodiment in a state similar to one shown in FIG. 2. The pillow-forming section 601 is folded over the three folded sections 604, 603, and 602 in a folding over direction 810, and the pocket piece 620 is pulled around the folded sections. The pillow is thereby formed.

In a variation of the finish of this folding sequence, the three folded sections 604, 603, and 602 are folded and tucked into the pillow-forming section, under the pocket piece 620, in a folding and tucking direction 812. A combination of pushing the folded sections into the pocket and pulling the pocket piece 620 around the folded sections may also be used.

An end result of a folding sequence or a variation is that the overlapping folded sections are tucked or otherwise inserted into the pocket to form the pillow. The pillow-forming section may be the only section still visible when the remaining sections of the pad are folded into the pocket.

Unfolding the pillow to form a baby changing pad may be performed in an unfolding sequence, which is a reversal of a folding sequence. An end result of an unfolding sequence is that the folding sections are unpacked from the pillow and the sections are unfolded to form the pad.

FIG. 9 shows a cross-section view of a pillow 900 similar to that of FIG. 2. Pocket piece 920, part of the pillow-forming section 901, is seen securing the remaining or residual folding sections. Stowage section 904, shown with lid 930, and middle sections 903 and 902 are shown folded in a zigzag or alternating manner, then roll folded and tucked into the pocket. Equivalently, the pocket is shown pulled around the folding sections. Following the folding sequence of FIGS. 6-8 results in a pillow 900 with the cross-section view of FIG. 9. In this folding sequence, the sections are folded in a zigzag followed by a roll fold.

A further folding sequence, using a double fold technique, achieves the same end result as shown in FIG. 9. With reference back to FIG. 1, the second end 416 of the pad 112 is folded to meet the first end 414 of the pad 112, thus folding the pad in half along fold line 152. The pad 112 is folded in half again, along fold lines 153 and 151, bringing fold line 152 over to meet the first end 414 and the second end 416 of the pad 112. Pocket fabric piece 202 is then lifted around the folded sections 102, 103, and 104, securing them within the pocket 110 and forming the pillow 900 shown in the cross-section view of FIG. 9.

Figure 10:
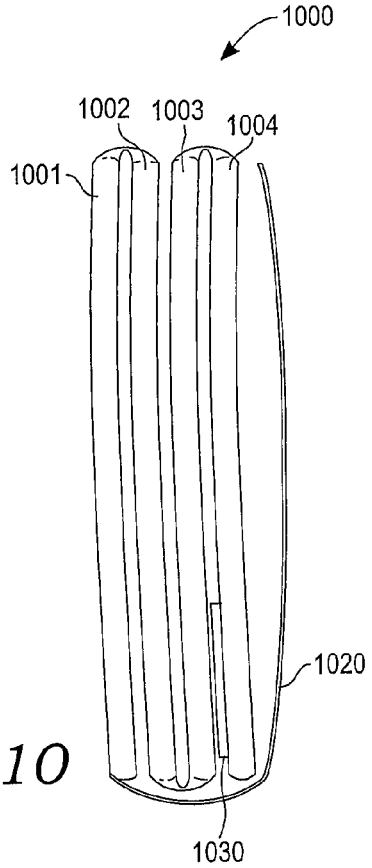
FIG. 10 is a cross-section view of the pillow of FIG. 2, showing the sections of the pad as folded with a further folding sequence and tucked into the pocket to form the pillow.

FIG. 10 shows a cross-section view of a pillow 1000 similar to that of FIG. 9 as related to FIG. 2, with the pad folded in a further folding sequence. Pocket piece 1020, part of the pillow-forming section 1001, is seen securing the remaining folding sections. Stowage section 1004, shown with lid 1030, and middle sections 1003 and 1002 are shown folded in a zigzag or alternating manner, then roll folded and tucked into the pocket. Equivalently, the pocket piece 1020 is shown pulled around the folding sections. In this further folding sequence, all of the sections are folded in a zigzag manner. Folding the initial segments of the pad in opposite directions from the folding sequence of FIGS. 6-7 results in a pillow 1000 with the cross-section view of FIG. 10. This folding sequence leaves a visible gap between pairs of folded sections (not shown in FIG. 2). The visible gap is shown in FIG. 10 as between folding sections 1002 and 1003.

Figure 11:
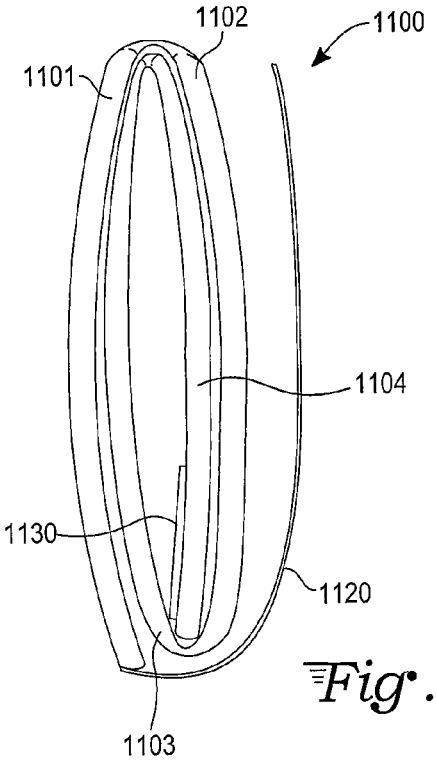
FIG. 11 is a cross-section view of the pillow of FIG. 2, showing the sections of the pad as folded with a still further folding sequence and tucked into the pocket to form the pillow.

FIG. 11 shows a cross-section view of a pillow 1100 similar to that of FIG. 9 as related to FIG. 2, with the pad folded in a still further folding sequence. Pocket piece 1120, part of the pillow-forming section 1101, is seen securing the remaining folding sections. Stowage section 1104, shown with lid 1130, middle sections 1103 and 1102 and pillow-forming section 1101 are shown folded in a spiral manner, then roll folded and tucked into the pocket. Equivalently, the pocket piece 1120 is shown pulled around the folding sections. In this further folding sequence the sections are not folded in a zigzag manner, rather they are folded upward one after the other in a spiral rolling manner. Similarly to the results of the folding sequence applied to produce the pillow 900 of FIG. 9, and unlike the folding sequence applied to produce the pillow 1000 of FIG. 10, the folding sequence applied to produce the pillow 1100 of FIG. 11 leaves no visible gap between pairs of folded sections, and produces a pillow similar in external appearance to that seen in FIG. 2.

With reference back to FIG. 1, the folding and tucking sequence of FIGS. 6-8 resulting in a pillow having the cross-section view of FIG. 9 may be visualized. Stowage section 104 is folded in a downward direction 161, underneath second middle section 103. Second middle section 103 and stowage section 104 are folded in an upward direction 162, on top of first middle section 102. The three folded sections 104, 103, and 102 are folded upwards and tucked, in an upwards and tucking direction 163, into the pocket 110 in the pillow-forming section 101 while the pillow-forming section 101 is opened in a pocket opening direction 164. The pocket piece 202 may be pulled around the folded sections 104, 103 and 102.

Figure 12:
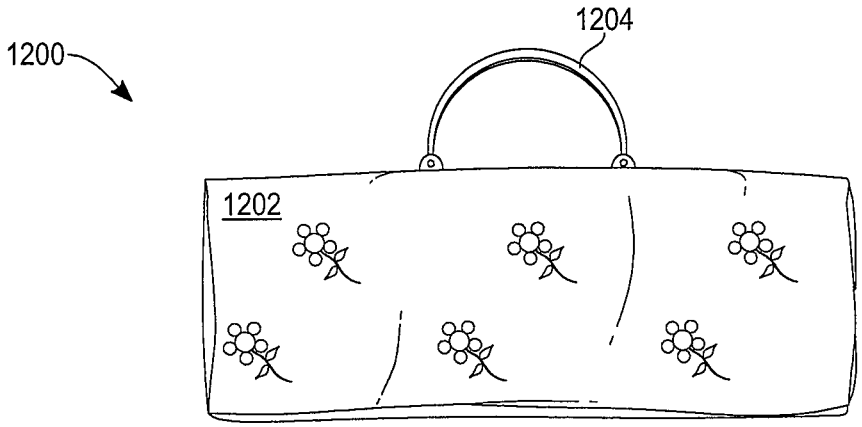
FIG. 12 shows an alternate embodiment of the apparatus of FIG. 1 as a pillow with a handle.

FIG. 12 shows an embodiment of a baby changing apparatus in a pillow 1200. The pillow 1202 has a handle 1204. The handle may be attached near where the pocket piece attaches to the pillow-forming section, near the fold line between the pillow-forming section and an adjacent section, to the pocket piece, to the pillow-forming section or at a location devised by a person skilled in the art.

Figure 13:
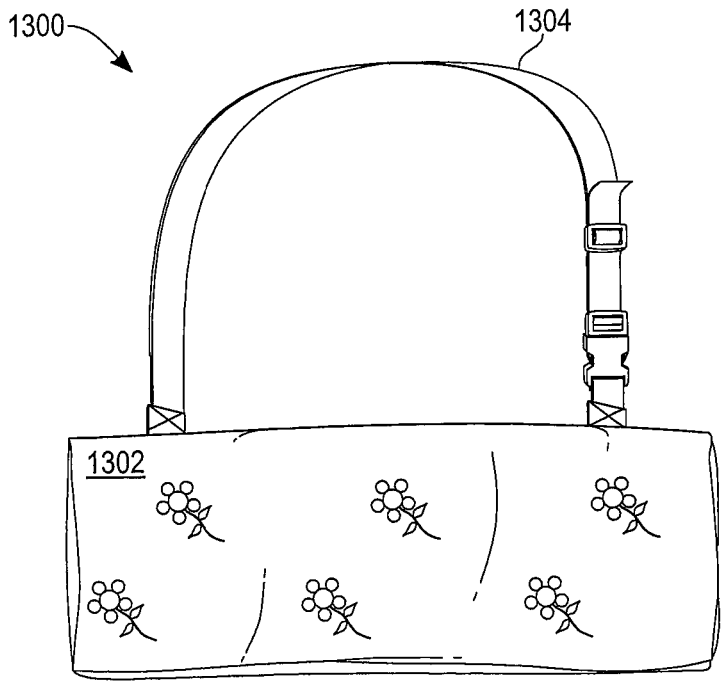
FIG. 13 shows an alternate embodiment of the apparatus of FIG. 1 as a pillow with an adjustable shoulder strap.

FIG. 13 shows an embodiment of a baby changing apparatus in a pillow 1300. The pillow 1302 has a strap 1304. The strap may be adjustable. The strap may be a shoulder strap. The strap may be attached near where the pocket piece attaches to the pillow-forming section, near the fold line between the pillow-forming section and an adjacent section, to the pocket piece, to the pillow-forming section or at a location devised by a person skilled in the art.

Figure 14:
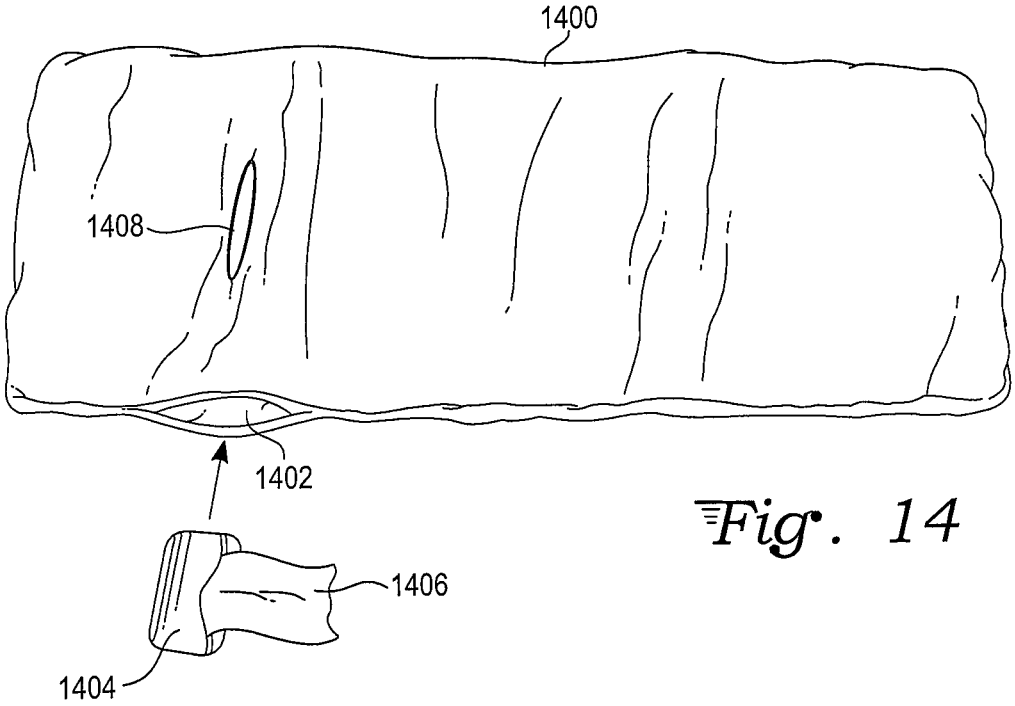
FIG. 14 is a top plan view of an embodiment of a changing pad with integral baby wipes in accordance with the invention.

With reference to FIG. 14, a generally flat baby changing pad 1400 has a stowage opening 1402 in a side of the pad, below the baby tending surface, allowing ingress of a container 1404 that dispenses baby wipes 1406 in a manner similar to the way that facial tissue is dispensed from a box of Kleenex (a trademark of Kimberly-Clark). A generally flat baby changing pad may have some curvature to accommodate the shape of a baby and for safety but such curvature is mostly near lateral edges. The pad or baby tending surface has a thickness dimension. The container 1404 has dimensions that fit through the opening 1402 into the thickness dimension and then resides in a first stowage volume below a slit 1408 in the surface of pad 1400 through which the baby wipes are dispensed or accessed.

Figure 15:
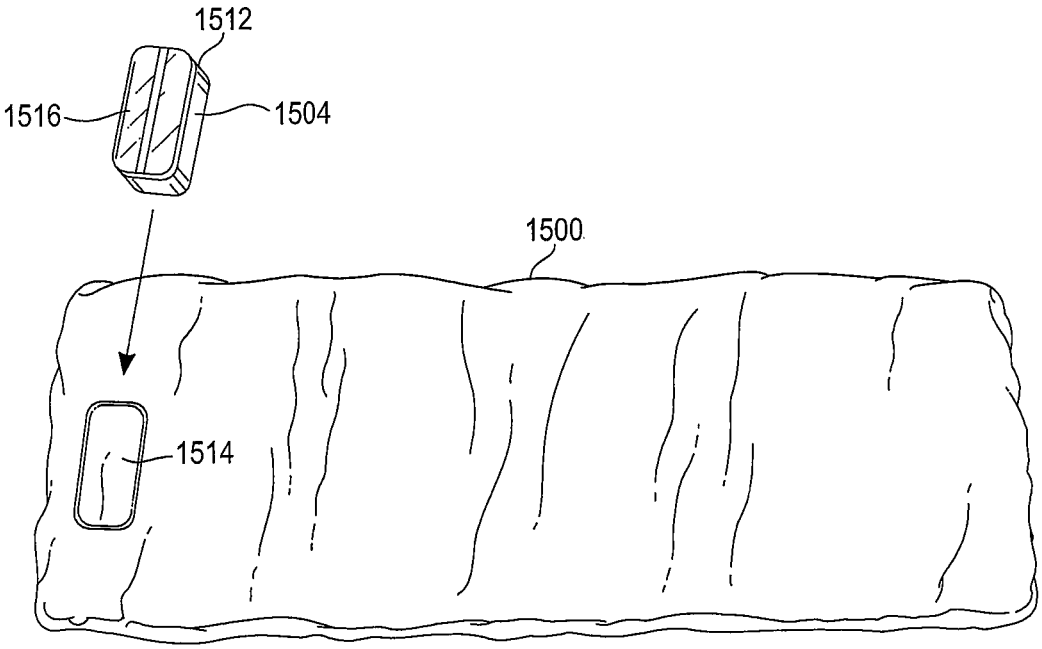
FIG. 15 is a top plan view of another embodiment of a changing pad with integral baby wipes in accordance with the invention.

In the embodiment of FIG. 15, a baby wipe container 1504 has a lip 1512. The container 1504 passes through the surface of changing pad 1500 into a stowage volume below the surface. The surface has a hard plastic rim 1514 that is sufficiently large to allow container 1504 to pass therethrough except for the lip 1512 which is stopped by lip 1512. The circumferential dimensions of container 1504 are slightly less than the circumferential dimensions of rim 1514. The rim 1514 is retained against the lip 1512 with rim 1514 pressing against the container and holding it in place when wipes are dispensed through a slit 1516 in the top of the container. The container 1504 may have a sealable lid. When closed, the lid appears to be a sealable lid in the baby changing surface that opens for access to baby wipes.

Further embodiments may have additional storage volumes, fewer or additional sections, some sections with or without foam or padding, and various sizes and dimensions. An embodiment may have one or more pockets added and accessible when formed as the pillow. An embodiment may include a cover for the pillow, which protects the material and is stored in a storage volume when not covering the pillow.

A further embodiment with six folding sections and a suitably sized pocket forms an extra large pillow. Two of the sections contain storage volumes for holding a pacifier, baby clothes, nursing cover, wipe case, diapers, nursing pads, diaper rash cream or other articles. Four of the sections have foam as padding.

A further embodiment may feature a non-folding changing pad, like a small mattress. Within an end of the mattress a storage volume is defined holding a container of baby wipes. The container may be inserted through the top surface of the pad or through the side.

In order to produce a foldable embodiment, the following method may be used. Cut fabric for the pocket piece and a long piece of cloth for the cloth surface. Cut vinyl for the liquid resistant surface. Install the lid in the vinyl, or make an arrangement in the vinyl for a removable container with a lid. Hem the overhang of the pocket piece. Attach the pocket piece to the long piece of cloth. Turn the material on the so-called wrong side, and sew the vinyl and cloth together as well as the top of the pocket piece that attaches to the pillow-forming section. Leave one long side open. Turn the work right side out. Insert each foam piece, one at a time, from the open long side. Sew adjacent to the foam piece to create a section. Repeat, for each foam piece. Sew the long sides together, excluding the last section. The last section is the stowage section, with one portion remaining openable to the side. Attach a hook and loop fastener or other fastener for securing the second storage volume of the stowage section. Additional construction details for elastics, fasteners, liners, fabric handling, variations, sewing or other attaching techniques and finishing touches are omitted but may be devised by a person skilled in the art. Techniques other than sewing and stitching may be used, for example thermal bonding. Materials other than fabric, woven fabric and vinyl may be used.

Figure 16:
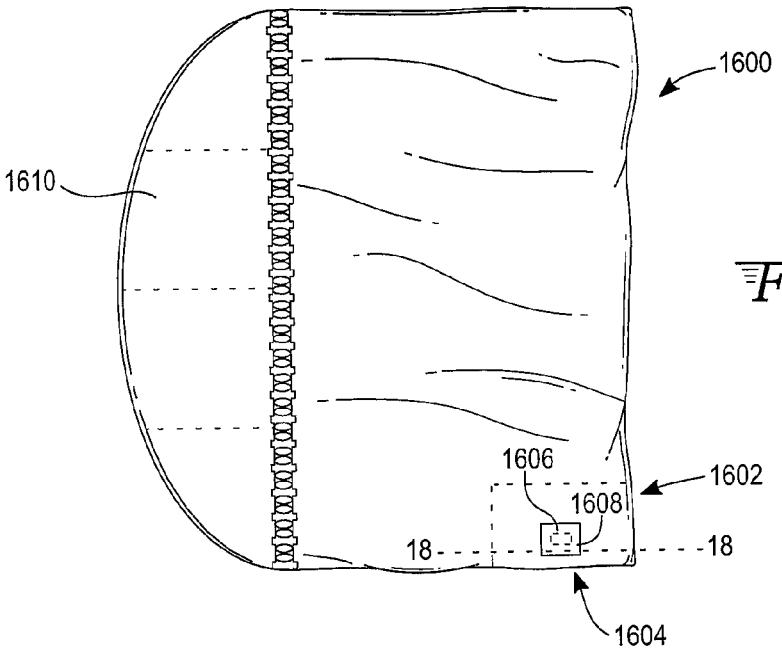
FIG. 16 is a top plan view of another embodiment of a changing pad with an internal waterproof pocket.
Figure 17:
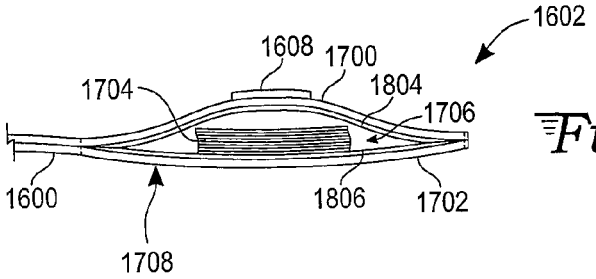
FIG. 17 is a front perspective view of the changing pad of FIG. 16.

With reference to FIGS. 16 and 17, a further embodiment of a changing pad 1600 is seen having an internal water-resistant pocket 1602 and a sealable end opening 1708 (FIG. 17) to the internal pocket along a portion 1604 of the length or the width of the pad for ingress of free wipes. The pocket further comprises a top opening 1606 in the pad 1600 and pocket 1602 to internal pocket compartment 1706 for dispensing wipes 1704 (FIG. 17). The top opening 1606 has a lid 1608 associated with it. In one example, the lid may 1608 be a flip lid secured with a pair of magnets (not shown). One magnet may be disposed in the lid and the other in the top of the pad to secure the lid when covering the opening 1606. In another example, the lid is a plastic lid that is heat sealed at portions to the top of the pad and is configured to cover and reveal the opening 1606. It is preferred that the lid is configured such that the top opening 1606 is impermeable to air or is airtight, or is substantially or somewhat impermeable to air to prevent the wipes from drying out. It is also preferred that the end opening 1708 is sealed such that it is airtight or substantially or somewhat impermeable to air to prevent the wipes from drying out. Using such lids or seals creates a pocket that is substantially or somewhat airtight. The baby changing pad 1600 is generally flat and, in this example, is curved at one end but may be of any desired shape. External pockets 1610 on the curved end may be used for storing baby items such as diapers.

Figure 18:
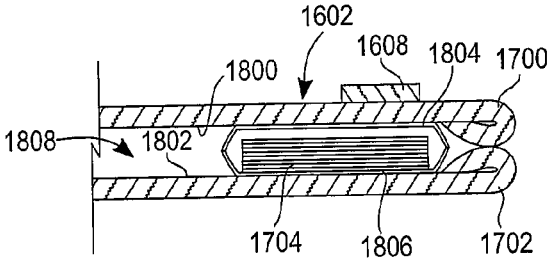
FIG. 18 is a cross sectional view taken along line 18-18 of FIG. 16.

With reference to FIGS. 17-18, it is seen that the baby changing pad 1600 has a top layer 1700 and a bottom layer 1702 forming a storage volume 1808 (FIG. 18) within which the internal water-resistant pocket 1602 is disposed. The internal water-resistant pocket 1602 is sandwiched between top layer 1700 and bottom layer 1702 and is fastened to internal surfaces 1800 and 1802 of the top and bottom layers in the storage volume 1808. A top layer 1804 of the pocket is in contact with internal surface 1800 of the top layer 1700 of the pad and a bottom layer 1806 of the pocket is in contact with internal surface 1802 of the bottom layer 1702 of the pocket. In one example, top ends of the layers 1804 and 1806 of the pocket 1600 are fastened to top ends of the internal surfaces 1800 and 1802 of the top and bottom layers 1700 and 1702, respectively. Adhesive may be used to fasten the internal water-resistant pocket to the internal surfaces. Opening 1606 is formed in top layer 1700 of the pad and top layer 1804 of the internal pocket 1602. The top layer 1804 and bottom layer 1806 of the internal pocket 1602 are preferably water-resistant and form the water-resistant internal pocket 1600. The top and bottom layers 1700 and 1702 of the baby changing pad may comprise canvas, thermoplastic polyurethane, a laminated fabric and/or other desired materials and may be connected together by sewing or other method at, for example, the ends of the pad.

Figure 19:
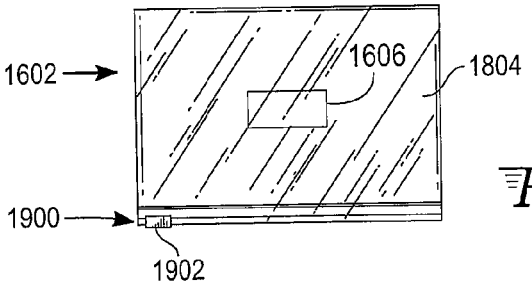
FIG. 19 is a perspective view of an internal waterproof pocket of FIG. 16.

With reference to FIG. 19, the internal pocket 1602 is seen separate from the baby changing pad 1600. The internal pocket, in one example, may comprise a plastic material such as a plastic laminate. In one example, the internal pocket comprises a plastic bag having a ZIPLOC bag type seal or fastener 1900 at a top end of the bag 1602. The bag is sealed at portions of layers 1804 and 1806, for example top portions of the fastener end, to internal surfaces 1800 and 1802 of the top of layers 1700 and 1702 and is disposed within the storage volume 1808 between the top and bottom layers. The sealable end opening 1708 is sealable with a fastener or fastening means. Preferably the fastener provides an airtight or substantially or somewhat airtight seal to the opening. The fastener may comprise a ZIPLOC bag type seal, plastic resealable zippers, slider zippers or other mechanisms for sealing the pocket opening 1708. In the example shown in FIG. 19, a slider 1902 is used to slide the ZIPLOCK type seal closed. The internal pocket 1602 comprises dimensions that are sufficient to store baby wipes 1704. For example, the length and width dimensions of the pocket are substantially the same as or slightly larger than the dimensions of a wipe.

A user is easily able to open the fastener or seal 1900 to place a stack of wipes 1704 into a storage space 1706 of the internal water-resistant pocket 1602 and seal the opening 1708 to prevent the drying out of wipes. When the user needs to access a wipe, the lid 1608 on the top opening 1606 is moved to reveal the opening through which a user may pull or otherwise access one or more wipes. As the internal pocket is water-resistant, the moisture of the wipes will not soak through the pad. As the sealed sides and closed top opening provide a substantially or somewhat airtight storage space for the wipes, the wipes are prevented from drying out.

What is claimed is:

1. A baby changing apparatus comprising:

a baby changing pad having a top layer, a bottom layer, a first end, a second end opposing the first end, and an internal pocket, one of the ends having a sealable end opening to the internal pocket, the internal pocket having a top water-resistant layer and a bottom water-resistant layer disposed between the top and bottom layers of the pad and accessible by the end opening, the top water-resistant layer of the pocket and the top layer of the pad having a top opening through which wipes are accessible, and a lid for closing the top opening.

2. The baby changing apparatus of claim 1, wherein the internal pocket has length and width dimensions slightly larger than length and width dimensions of a wipe.

3. The baby changing apparatus of claim 1, wherein the sealable end opening to the internal pocket is sealable with a fastener.

4. The baby changing apparatus of claim 3, wherein the fastener is a slider zipper.

5. The baby changing apparatus of claim 3, wherein the fastener provides a substantially airtight seal to the internal pocket.

6. The baby changing apparatus of claim 1, wherein the pad is comprised of a laminated fabric.

7. The baby changing apparatus of claim 1, wherein the pad is comprised of canvas.

8. The baby changing apparatus of claim 1, wherein the pad is comprised of thermoplastic polyurethane.

9. The baby changing apparatus of claim 1, wherein the internal pocket is comprised of a plastic laminate.

10. The baby changing apparatus of claim 1, wherein the internal pocket is fastened at its ends to internal surfaces of the top and bottom surfaces of the pad.

11. A baby changing apparatus comprising:

a baby changing pad having a top layer and a bottom layer forming an internal volume therebetween, an internal water-resistant pocket disposed in the internal volume and fastened to the top and bottom layers, the pad having an end opening to the internal pocket, the end opening disposed along a portion of the width or length of the pad and for placing wipes in the internal pocket, and a top opening to the internal pocket for dispensing wipes.

12. The baby changing apparatus of claim 11, further comprising a lid for the top opening.

13. The baby changing apparatus of claim 11, wherein the internal water-resistant pocket is approximately the same length and width as a baby wipe.

14. The baby changing apparatus of claim 11, wherein the pocket is comprised of a plastic laminate.

15. The baby changing apparatus of claim 11 wherein the pocket is sealed at portions to internal surfaces of the baby changing pad.

* * * * *